United States Patent [19]

Mehaffey et al.

[11] Patent Number: 4,892,649

[45] Date of Patent: Jan. 9, 1990

[54] CALCIUM CARBONATE BENEFICIATION

[75] Inventors: Joseph L. Mehaffey, Lockport; Thomas C. Newman, Hinsdale, both of Ill.

[73] Assignee: Akzo America Inc., New York, N.Y.

[21] Appl. No.: 206,247

[22] Filed: Jun. 13, 1988

[51] Int. Cl.[4] ..... B03D 1/02

[52] U.S. Cl. ..... 209/166; 252/61

[58] Field of Search ..... 209/166, 167; 252/61; 241/24; 423/173, 430, 635, 636

[56] References Cited

U.S. PATENT DOCUMENTS

| | | | |
|---|---|---|---|
| 2,132,902 | 10/1938 | Lenher | 209/166 |
| 2,362,276 | 11/1944 | Jayne | 209/166 |
| 2,380,698 | 7/1945 | Jayne | 209/166 |
| 2,494,132 | 1/1950 | Jayne | 209/166 |
| 4,737,273 | 4/1988 | Snow | 209/166 |

FOREIGN PATENT DOCUMENTS

| | | | |
|---|---|---|---|
| 119764 | 4/1945 | Australia | 209/166 |
| 1187212 | 5/1985 | Canada | 209/166 |
| 2489714 | 3/1981 | France | 209/166 |

*Primary Examiner*—David L. Lacey
*Assistant Examiner*—Thomas M. Lithgow
*Attorney, Agent, or Firm*—Louis A. Morris

[57] ABSTRACT

A process for purifying calcium carbonate ore by the removal of silicate impurities from the ore by reverse flotation. The process achieves high yields and low acid insoluble content of the calcium carbonate product by employing novel collectors. These novel collectors which characterize the invention comprise organonitrogen compounds including propoxylated quaternary ammonium compounds, unsymmetrical dialkyl dimethyl quaternary ammonium compounds and dialkyl hexahydropyrimidine compounds.

2 Claims, No Drawings

CALCIUM CARBONATE BENEFICIATION

BACKGROUND OF THE INVENTION

Calcium carbonate (calcite) is found in limestone rock along with various mineral impurities, particularly silicates such as, quartz, mica, feldspar, etc. The most common known methods for separating the calcite from the mineral impurities involve physical separations whereby the limestone rock is first ground and slurried and the ground material is subject to flotation by employing some means which selectively imparts hydrophobicity to certain of the components of the rock to enable such components to be floated away. In the reverse flotation process it is the impurities which are floated away from the calcite.

Means to provide hydrophobicity to the impurities in the reverse flotation process are numerous and well known to the art, including, from U.S. Pat. No. 3,990,966 to Stanley et al, 1-hydroxyethyl-2-heptadecenyl glyoxalidin, 1-hydroxyethyl-2-alkylimidazolines and salt derivations of the imidazoline. Canadian Publication 1187212 discloses, the following quaternary amines or salts thereof for use as collectors: dimethyl dialkyl with the alkyl groups containing 8 to 16 carbon atoms and being optionally unsaturated and optionally branched; and dimethyl alkyl benzyl with the alkyl containing 10 to 22 carbon atoms and being a normal aliphatic; and bis-imidazoline containing 12 to 18 carbon atoms in optionally unsaturated normal alkyls.

Another collector in common use is a combination of N-tallow-1,3-diaminopropane diacetate (Duomac T) and a tertiary amine having one long carbon chain alkyl group and two polyoxyethylene groups attached to the nitrogen (Ethomeen 18/60). The latter compound serves as a dispersant. A significant disadvantage to the use of this combination is that both compounds of the combination are high melting point solids and to be used must be dispersed in water with a high energy blender and/or heating and then mixed so as to remain in suspension.

Arquad 2C (dicocodimethylammonium chloride) is also a known collector, but it requires an alcoholic solvent system to facilitate its manufacturing process which can cause flammability problems during manufacturing, storage and use of the product. This product also has a relatively high pour and cloud point.

We have discovered certain organo-nitrogen compound collectors which are at least as effective as known prior art collectors, and better than most, but which are able to function as single liquid collectors and which are relatively inexpensive to manufacture and readily available.

SUMMARY OF THE INVENTION

Accordingly, the present invention is a process for the purification of a calcium carbonate ore containing silicate impurities. The process comprises grinding and forming an aqueous slurry of the ore, adding an effective amount of collector to the slurry and separating the impurities from the slurry by floating away the impurities which have been made hydrophobic by the effect of the collector. The collector to be used is at least one of the organo-nitrogen compounds from the group comprising propoxylated quaternary ammonium compounds, unsymmetrical dialkyl dimethyl quaternary ammonium compounds and dialkyl hexahydropyrimidine compounds.

Other embodiments of the present invention encompass details as to specific collector compositions and dosages of collector utilized.

DESCRIPTION OF THE INVENTION

Flotation processes for removing silicate impurities from calcium carbonate ore are well known to the art. An excellent discussion of the reverse flotation process may be found in the aforementioned U.S. patent to Stanley et al (incorporated herein by reference). Briefly, the ore is ground in one or more types of commercially available mills to obtain an aqueous slurry of about 20 to 40 wt. % solids of particles having sizes less than 325 mesh. The slurry is passed through a flotation machine into which the collector (or flotation agent) is also added and from which a froth containing the silicate impurities may be skimmed. The purified slurry is then classified to obtain calcites of various particle sizes, and the classified products are thickened, settled and dried. Flotation conditions are ambient or whatever temperature the water supply may comprise.

The flotation process has enabled the production of high brightness calcium carbonate by removing the silicate impurities from the calcium carbonate ore which would otherwise be responsible for color imperfections in the finished product. The aforementioned combination of Duomac T and Ethomeen 18/60 is still being used in such process, but there are single liquid collectors which have, in some cases, replaced this two solid product system. The aforementioned Arquad 2C as well as certain imidazoline quaternaries are examples of single liquid collectors, but they are not as effective as the collectors we have discovered.

The most important criteria in evaluating the performance of a calcium carbonate ore collector are: (1) effective dosage level required; (2) Yield, which is defined as the percent of calcium carbonate which does not float away during the reverse flotation; and (3) Acid Insoluble, a measurement of silicate impurities in the beneficiated ore (the percent of the calcium carbonate product which remains following reaction with hydrochloric acid). Commercial goals for such criteria are a dosage level of from about 0.1 to about 0.5 pounds of collector per ton of ore, a Yield at least about 90% and an Acid Insoluble of less than about 0.5%. Of course, as discussed above, other considerations such as whether the collector comprises a single liquid system, its effect on product properties and its comparative cost can also be very important.

Of the almost infinite number of organo-nitrogen compounds having potential utility as collectors in reverse flotation, we have found propoxylated quaternary ammonium compounds, unsymmetrical dialkyl dimethyl quaternary ammonium compounds and dialkyl hexahydropyrimidines to be particularly useful and advantageous. Other moities may be present in these compounds due to the routes used to accomplish the respective synthesis. For example, in a collector the alkoxy group may be present due to the use of an alcohol in carrying out the synthesis. The alkyl groups in the above chemical formulas may include saturated and unsaturated fatty alkyls having carbon chain lengths of 8 to 22, except that, with regard to the dialkyl hexahydropyrimidines, the alkyl group associated with a carbon atom in the pyrimidine ring must have a carbon atom chain length of at least 1.

With respect to the propoxylated collector, there may be 2 to about 10 moles of propoxylation.

Anions which may be associated with the collectors include methyl sulfate, chloride, acetate, borate, etc.

The following non-limiting examples provide the data and observations on which our findings are based. The collectors are referred to in the Tables of the examples in abbreviated form having the following meanings (unless previously identified):

| Abbreviation | Chemical Formula |
|---|---|
| DDQ | dimethyl-didecylquaternary ammonium chloride |
| MCS | mehtyl-bis (2 hydroxypropyl) cocoalkylammonium methyl sulfate |
| SEH | dimethyl-di (2-ethylhexyl) ammonium chloride |
| UEH | dimethyl (2-ethylhexyl) cocoalkylammonium chloride |
| PTE | polyoxyethylene(50) triethenolamine |
| MTE | methylpolyoxyethylene (50) triethanol ammonium chloride |
| ITH | 2-isopropyl-3-tallowalkyl-hexahydropyrimidine |
| TH | 3-tallowalkylhexahydro-pyrimidine |

EXAMPLE 1

A slurry of untreated calcium carbonate ore (3.4% Acid Insoluble) was prepared for use in thirteen test runs each of which employed a different collector. A Denver Sub-A Laboratory Flotation Machine was employed with an ore charge of 450 grams and sufficient tap water to result in 30% solids. The conditioning time was one minute with an impeller speed of 1100 rpm. Results were obtained with a single stage collector addition. The results are set forth in the following Table 1.

TABLE 1

FLOATATION RESULTS

| RUN NO. | COLLECTOR | DOSE, LBS./TON | YIELD % | ACID INSOL-UBLE, % |
|---|---|---|---|---|
| 1 | DDQ | 0.80 | 78.9 | 0.2 |
| 2 | Arquad 2C | 0.80 | 93.7 | 0.4 |
| 3 | DDQ | 0.40 | 94.2 | 0.5 |
| 4 | DDQ | 0.20 | 99.6 | 3.2 |
| 5 | DDQ(MIBC) | 0.40 | 91.0 | 0.3 |
| 6 | Arquad 2C (IPA + MIBC) | 0.40 | 93.9 | 0.5 |
| 7 | MCS | 0.40 | 90.2 | 0.4 |
| 8 | SEH | 0.40 | 90.1 | 0.9 |
| 9 | UEH | 0.40 | 89.1 | 0.3 |
| 10 | Duomac T | 0.30 | 73.1 | 0.4 |
| | Ethomeen 18/60 | 0.10 | | |
| 11 | Duomac T | 0.30 | 47.0 | 0.5 |
| | PTE | 0.10 | | |
| 12 | Duomac T | 0.30 | 50.4 | 0.5 |
| | MTE | 0.10 | | |
| 13 | ITH | 0.30 | 94.4 | 0.6 |
| | Ethomeen 18/60 | 0.10 | | |

Referring to Table 1, the first two runs may be discounted since they were both at a dosage level of 0.80 pounds per ton of ore which far exceeds the commercial goal of from about 0.1 to about 0.5 pounds per ton. The following runs shown in Table 1 are all with a dosage level of 0.40 lb/ton of collector, including dispersants when used, but not including solvents.

The third run, which employed DDQ may be considered as a control for single liquid systems. It was able to achieve, however, an Acid Insoluble not lower than 0.5%. When the dosage was lowered to 0.20 pounds per ton (run 4), the Acid Insoluble went up to 3.2%. Only when mixed with 50 wt.% MIBC (methyl isobutyl carbinol) in run 5 was performance with Arquad 210 acceptable, but MIBC is expensive and, of course, precludes the achievement of a single liquid system.

Run 6 illustrates Arquad 2C with its accompanying alcoholic (isopropyl alcohol) MIBC solvent system which is still not able to achieve an acceptable Acid Insoluble level.

Run 7 illustrates the embodiment of the present invention employing a propoxylated quaternary ammonium compound (MCS). This is the first instance of all goals being achieved, including dosage, Yield and Acid Insoluble for a single liquid system.

Run 8 and 9 illustrate the performance of a symmetrical dialkyl dimethyl quaternary ammonium compound (SEH) as opposed to the unsymmetrical quaternary of the present invention, in this case UEH. The difference in Acid Insolubles (0.9% in run 8 vs. 0.3% in run 9) is striking.

Run 10 shows the performance of the aforementioned Duomac T-Ethomeen 18/60 system, which, in addition to comprising an undesirable blend of solids, does not even achieve an acceptable Yield.

Runs 11 and 12, which use a collector similar to run 10 except for the respective PTE and MTE dispersants, achieve even worse results than in run 10, with respect to both yield and Acid Insolubles.

Run 13 employs ITH, which is an embodiment of the present invention, but it is mixed with Ethomeen 18/60 dispersant. The Acid Insoluble level obtained through use of this mixture was unacceptable, at least for the particular calcium carbonate ore sample employed.

EXAMPLE 2

Additional test work was carried out to determine whether the ITH was a viable collector without a dispersant. A new sample of calcium carbonate ore was used for the tests. The data obtained over three test runs is shown in the following Table 2.

TABLE 2

| RUN NO. | COLLECTOR | DOSE, LBS./TON | YIELD % | ACID INSOL-UBLE, % |
|---|---|---|---|---|
| 1 | Duomac T | 0.11 | 96.2 | 0.2 |
| | Ethomeen 18/60 | 0.08 | | |
| 2 | ITH | 0.19 | 89.4 | 0.2 |
| 3 | ITH | 0.15 | 93.3 | 0.5 |
| 4 | TH | 0.30 | 98.0 | 0.9 |

The results of Table 2 illustrate the effectiveness of the ITH embodiment of the present invention, even at a dosage level of as low as 0.19 lbs/ton. Run 1 used a known double solid collector and may be considered the control for this example. Run 2 shows the performance of straight ITH at the same dosage level to fully meet the required performance criteria. Even at a dosage level as low as 0.15 lbs/ton (Run 3), the ITH exceeds the Acid Insoluble criteria only by a slight amount.

On the other hand, Run 4 which employed TH where there is no alkyl group associated with a carbon atom in the pyrimidine ring, demonstrated an unacceptably high Acid Insoluble.

We claim:

1. A process for purifying calcium carbonate ore containing silicate impurities comprising grinding and forming an aqueous slurry of said ore, adding an effective amount of a collector selective for said silicate impurities to said slurry comprising dimethyl (2-ethylhexyl) cocoammonium chloride, and subjecting said slurry containing said silicate impurity collector to froth flotation thereby floating the silicate impurities away from a resultant slurry containing purified calcium carbonate.

2. The process of claim 1 wherein the amount of said collector added to said slurry comprises from about 0.1 to about 0.5 pounds per ton of ore.

* * * * *